US007401426B2

(12) United States Patent
Nielsen

(10) Patent No.: US 7,401,426 B2
(45) Date of Patent: Jul. 22, 2008

(54) METHOD AND DEVICE FOR INTRODUCING ESSENTIALLY RECTANGULAR PIECES OF CLOTH INTO A FEEDER

(75) Inventor: Steen Nielsen, Rønne (DK)

(73) Assignee: Jensen Denmark A/S, Ronne (DK)

( * ) Notice: Subject to any disclaimer, the term of this patent is extended or adjusted under 35 U.S.C. 154(b) by 0 days.

(21) Appl. No.: 10/516,607

(22) PCT Filed: Jun. 10, 2003

(86) PCT No.: PCT/DK03/00380

§ 371 (c)(1),
(2), (4) Date: May 17, 2005

(87) PCT Pub. No.: WO03/104542

PCT Pub. Date: Dec. 18, 2003

(65) Prior Publication Data

US 2005/0211530 A1 Sep. 29, 2005

(30) Foreign Application Priority Data

Jun. 7, 2002 (DK) ..... 2002 00868

(51) Int. Cl.
*D06F 67/04* (2006.01)
*D06F 61/00* (2006.01)

(52) U.S. Cl. ..... 38/143

(58) Field of Classification Search ..... 198/570, 198/411, 412, 587, 597; 162/270; 38/143; 414/13

See application file for complete search history.

(56) References Cited

U.S. PATENT DOCUMENTS 826,066 A * 7/1906 Scovell ..... 198/300
1,445,797 A * 2/1923 Peirce ..... 198/534
2,640,444 A * 6/1953 Reget ..... 414/413
3,455,447 A * 7/1969 Bucher ..... 209/692

(Continued)

FOREIGN PATENT DOCUMENTS

EP 0 573 810 A1 12/1993

(Continued)

OTHER PUBLICATIONS

Jensen, "Device for Inserting Laundry Into a Feeder", Abstract of Denmark Patent No. 9400491 (Oct. 29, 1995).

*Primary Examiner*—Ismael Izaguirre
(74) *Attorney, Agent, or Firm*—Finnegan, Henderson, Farabow, Garrett & Dunner, L.L.P.

(57) ABSTRACT

A device for feeding essentially rectangular pieces of cloth to a feeder, comprising a conveyor on which pieces of cloth can be advanced in the direction of conveyance of the feeder, and on which, in front of the conveyor, there is configured a boom extending transversely of the direction of conveyance of the conveyor, and wherein the boom comprises a boom conveyor in the longitudinal direction of the boom configured for conveying the piece of cloth across the boom, and at the end of the boom, means are configured for transferring the piece of cloth from a feed conveyor to the boom, wherein the means for transferring the piece of cloth from the feed conveyor to the boom conveyor is configured such that it is able to turn the piece of cloth in an area between the feed conveyor and the boom conveyor.

11 Claims, 4 Drawing Sheets

Figure 1:
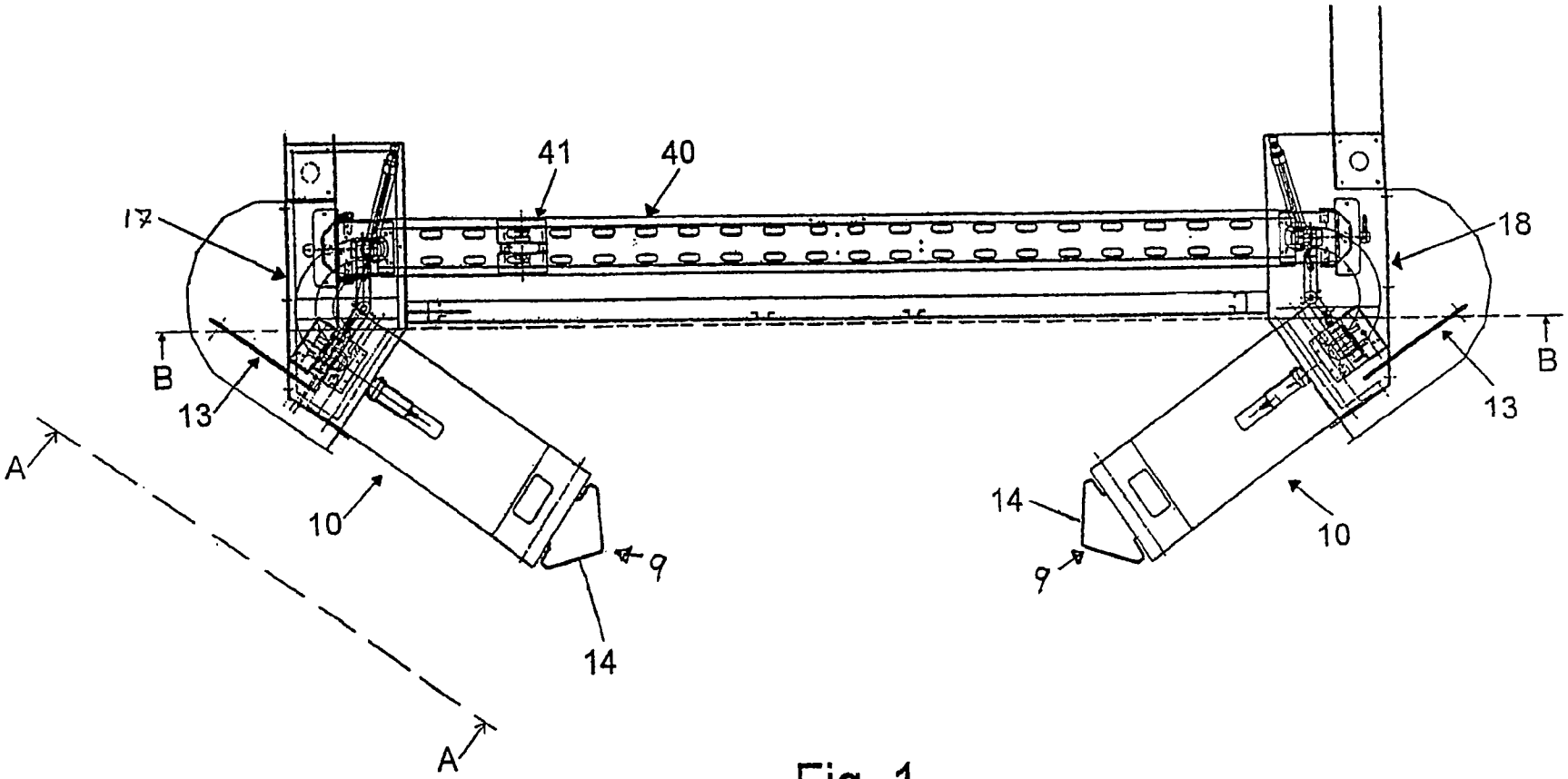

U.S. PATENT DOCUMENTS 3,729,846 A * 5/1973 Weir ..... 38/143
5,169,282 A * 12/1992 Ueda et al. ..... 414/800
5,349,768 A * 9/1994 Ishihara et al. ..... 38/143
5,419,439 A * 5/1995 Branch ..... 209/3.3
5,437,114 A * 8/1995 Kuipers ..... 38/143
5,440,810 A * 8/1995 Borucki et al. ..... 38/143
5,515,627 A * 5/1996 McCabe ..... 38/143
5,606,811 A 3/1997 Jensen

FOREIGN PATENT DOCUMENTS

EP 0 666 360 A1 8/1995
EP 0 679 756 A1 11/1995
GB 2219313 A * 12/1989

* cited by examiner

METHOD AND DEVICE FOR INTRODUCING ESSENTIALLY RECTANGULAR PIECES OF CLOTH INTO A FEEDER

The present invention relates to a device for introducing essentially rectangular pieces of cloth into a feeder, comprising a conveyor on which pieces of cloth can be advanced in the direction of conveyance of the feeder, and on which, before the conveyor, a boom is provided that extends transversally to the direction of conveyance of the conveyor, and wherein the boom comprises a boom conveyor in the longitudinal direction of the boom configured for conveying the piece of cloth across the boom, at least from the one end of the boom, wherein, at the end of the boom, means are configured for transferring the piece of cloth from an feed conveyor (feeder device) to the boom, and wherein, likewise at the end of the boom, a feed conveyor is provided with a feeding position and conveyor means for conveyoring pieces of cloth, wherein a straightened front edge of a piece of cloth is received from the feeding position and conveyed to the transfer position, from where the straightened front edge of the piece of cloth is received by the means for transferring the piece of cloth from the feed conveyor to the boom and is transferred to said boom conveyor for conveying the piece of cloth across the boom.

Feeders are used primarily in laundry facilities, where they are used for unfolding large pieces of cloth, such as sheets, tablecloths, eiderdown cases and other essentially rectangular pieces of cloth in order to prepare them for being subsequently treated in eg a rotary ironer. Therefore, it is important that the piece of cloth is unfolded and smoothened efficiently prior to the ironing with the rotary ironer, in order to prevent unintended press folds in the piece of cloth by the ironing with the rotary ironer. Most often feeders comprise a feed conveyor for the feeding of pieces of cloth into the feeder, wherein the piece of cloth is introduced into the feeder by a method like the one described above. The pieces of cloth are most often taken from a pile of creased pieces of cloth that may also be either wet or moist and are most often introduced into the feeder which subsequently treats the piece of cloth to the effect that it can be transferred to eg a rotary ironer in straightened and smoothened state.

EP patent No. 666 360 teaches a method and an apparatus, by which the piece of cloth is not aligned and straightened prior to it being conveyed into the feeder as such. This is accomplished in that the piece of cloth is suspended across the conveyor with a relatively large part of it hanging to the one side of the conveyor and a relatively small part of it to the other side, and wherein the fold, by which the laundry article sits across the conveyor, is lifted by means of a bar that subsequently presses the piece of cloth between two opposed conveyor faces situated to be resiliently engaged with each other, whereby the laundry article is conveyed on the one conveyor face of the feeder that has means for correctly orienting and unfolding the laundry items. Hereby a relatively high productivity of feeding of laundry articles is obtained, since the initial aligning and straightening of the pieces of laundry can be avoided and be performed at a later stage, in the feeder.

Moreover, feeders are known the applicant's Danish application No. 0491/94 that teaches an apparatus for unfolding and feeding essentially rectangular pieces of cloth into a cloth-treatment apparatus, such as a rotary ironer, wherein said feeder comprises a transverse boom with a boom conveyor, across which boom the piece laundry articles is positioned straightened hanging essentially freely and folded with a first part of the piece of cloth hanging down to the one side of the boom conveyor and the other part to the other side, and wherein, at the one end of the boom, or at both ends, an operator-operated feed conveyor is configured comprising therein two subjacent conveyor belts (a subjacent run path) above which two parallel superjacent conveyor belts are arranged, such that they are in fixed abutment on the subjacent conveyor belts.

Feeders in accordance with the prior art present the advantage that pieces of cloth are in an effective manner introduced into the feed conveyor of a feeder without presupposing the full attention of an operator during the feeding process to ensure that the piece of cloth is not introduced askew into the feeder. Therefore the operator is able to fetch and prepare another piece of cloth for being fed into the feed conveyor, while said first piece of cloth is conveyed between the superjacent conveyor belts and the subjacent conveyor belts and onto the boom conveyor.

However, feeders in accordance with the prior art presupposes that feeding takes place from feeding positions in the transverse direction of the feeder, seen from the direction of conveyance of the conveyor through the feeder. When a transverse boom is used, where a piece of cloth is taken from the feed conveyor and transferred to a boom conveyor on the boom, it will unavoidably be required, in order to enable full utilisation of the machine capacity, to provide feeding stations with feed conveyors at both ends of the boom.

Thereby the immediate drawbacks of this type of feeder appear as the two feeding stations of the machine located at the sides of the feeder, seen from the direction of conveyance of the conveyor, will require that pieces of cloth for being fed to the feeder are to be brought to two feeding stations. Additionally, the construction with two feeding stations located at the sides of the feeder, seen from the direction of conveyance of the conveyor through the conveyor, presupposes that there has to be provided workstations and the handling area necessary therefor at both feeding stations; and it follows that the overall requisite space needed for the feeder's width—transversally to the direction of conveyance of the conveyor—is considerable.

It is the object of the present invention to provide a device for feeding essentially rectangular pieces of cloth into a feeder whereby it is accomplished that the feed conveyor is, other things being equal, able to feed pieces of cloth to a feeder with a relatively larger working width in relation to the overall need for space for the width of the feeder—transversally to the direction of conveyance of the conveyor.

This is accomplished by the features recited in the characterising portion of claim 1, wherein the position of feeding is located in a position situated before the direction of conveyance of the conveyor and between the ends of the boom, whereby it is possible to provide a feeder with a comparatively larger working width in relation to the overall need for space for the width of the feeder—transversally to the direction of conveyance of the conveyor.

It will hereby be possible to mount the feeder without having to take into consideration that there has to be an indispensable working and handling area for the positions of feeding that forcedly have to be arranged at the sides of the feeder in the direction of conveyance. In laundries a number of production lines are most often arranged side-by-side. These production lines comprise eg a feeder followed initially by rotary ironer and subsequently eg a stacker for folding the treated pieces of cloth. By use of a feeder according to the invention it will therefore be possible to arrange these production lines in a side-by-side relationship and more closely to each other than is possible with feeders according to the prior art, wherein the positions of feeding are configured at the sides of the feeder.

Furthermore, the feeder according to the invention also enables that there is a need for configuring positions of feeding only at the front side of the feeder, ie before the boom seen in the direction of conveyance. Thereby it is enabled that, as opposed to a feeder with two feeding stations located at the sides of the feeder, seen in the direction of conveyance of the conveyor, it is necessary to arrange work stations only at the front of the feeder in front of the boom. Thereby it is necessary to feed pieces of cloth for being fed to the feeder only at one work station at the front side, which results in increased performance as it is not necessary to have to keep two work stations fully supplied with pieces of cloth for feeding.

According to a preferred embodiment of the invention, a feed conveyor is provided at both ends of the boom, thereby enabling feeding of pieces of cloth at both ends of the boom, which increases the capacity of the feeder.

According to an alternative preferred embodiment the positions of feeding are arranged between the ends of the boom, and furthermore the angle between the direction of conveyance of the conveyor and the direction of conveyance of the feeder is between 190° and 260°, preferably between 210° and 240°, and the turning direction is configured for receiving the front edge of the piece of cloth from the feed conveyor and subsequently turning the front edge of the piece of cloth an angle corresponding to the above identified ones, following which the front edge is received by the boom conveyor. Hereby it is accomplished that the feed conveyor can be adapted to the current-needs, including location of pieces of cloth for feeding at the front of the feeder.

According to a further preferred embodiment of the invention, the conveyor means, the turning device and the boom conveyor of the feeder are independent units that comprise each their securing means and each their control. Thereby it is obtained that each unit is able to temporarily store a piece of cloth in those cases where the piece of cloth cannot be transferred to a subsequent unit due to the subsequent unit not having completed its treatment of the piece of cloth.

According to a further preferred embodiment the conveyor means of the feed conveyor comprise two parallel conveyor belts that run synchronously, and the turning device comprises a pair of independently operating squeezers. Thereby it is accomplished that, at all times, pieces of cloth will be spread out between said conveyor belts/squeezers without becoming askew before being transferred between the turning device and the squeezer means on the boom conveyor.

According to yet a preferred embodiment said boom conveyor comprises a tilting device with squeezer devices at both ends with a view to the one squeezer pair being able to securely squeeze pieces of cloth from the one turning device, and the other squeezer pair being able to securely squeeze pieces of cloth from the other turning device. Thereby it is accomplished that the squeezer means on the boom conveyor are able to secure and convey the piece of cloth out onto the transversely extending boom from a feed conveyor configured to both sides of the feeder.

Since the feed conveyor and the turning device are separate units, it is an option that each of them may temporarily store a piece of cloth thereby eliminating the need for the operator to wait for a piece of cloth to be conveyed through the feeder before feeding the next one to the feed conveyor.

According to a further preferred embodiment a guide means is configured in connection with the feed conveyor, wherein said guide means has an expanse oriented in extension of and in the same direction as the direction of conveyance of the feed conveyor; the piece of cloth travelling, by the transfer by the turning device of the piece of cloth from the feed conveyor to the boom conveyor, across the guide means thereby avoiding that the adverse folds are imparted to the piece of cloth prior to the piece of cloth travelling along with the boom conveyor across the boom.

In connection with the feeding of pieces of cloth that are not spread to the extent needed, and wherein it is desired to have a feeder with a relatively large working width, claim 10 recites a method for feeding essentially rectangular pieces of cloth to a feeder, by which method a straightened front edge of the piece of cloth in a feeding position is introduced into a feeding conveyor and conveyed to a second position, and wherein said straightened front edge of the piece of cloth is, at a third position, taken over by the means configured on a boom conveyor for conveyance across a boom, wherein said straightened front edge of the piece of cloth is received by a turning device for transfer to a third position; and wherein said straightened front edge of the piece of cloth is, in from said second position, turned with an essentially horizontal movement to said third position for receiving the conveyor means arranged on the boom conveyor for conveyance across the boom.

Figure 2:
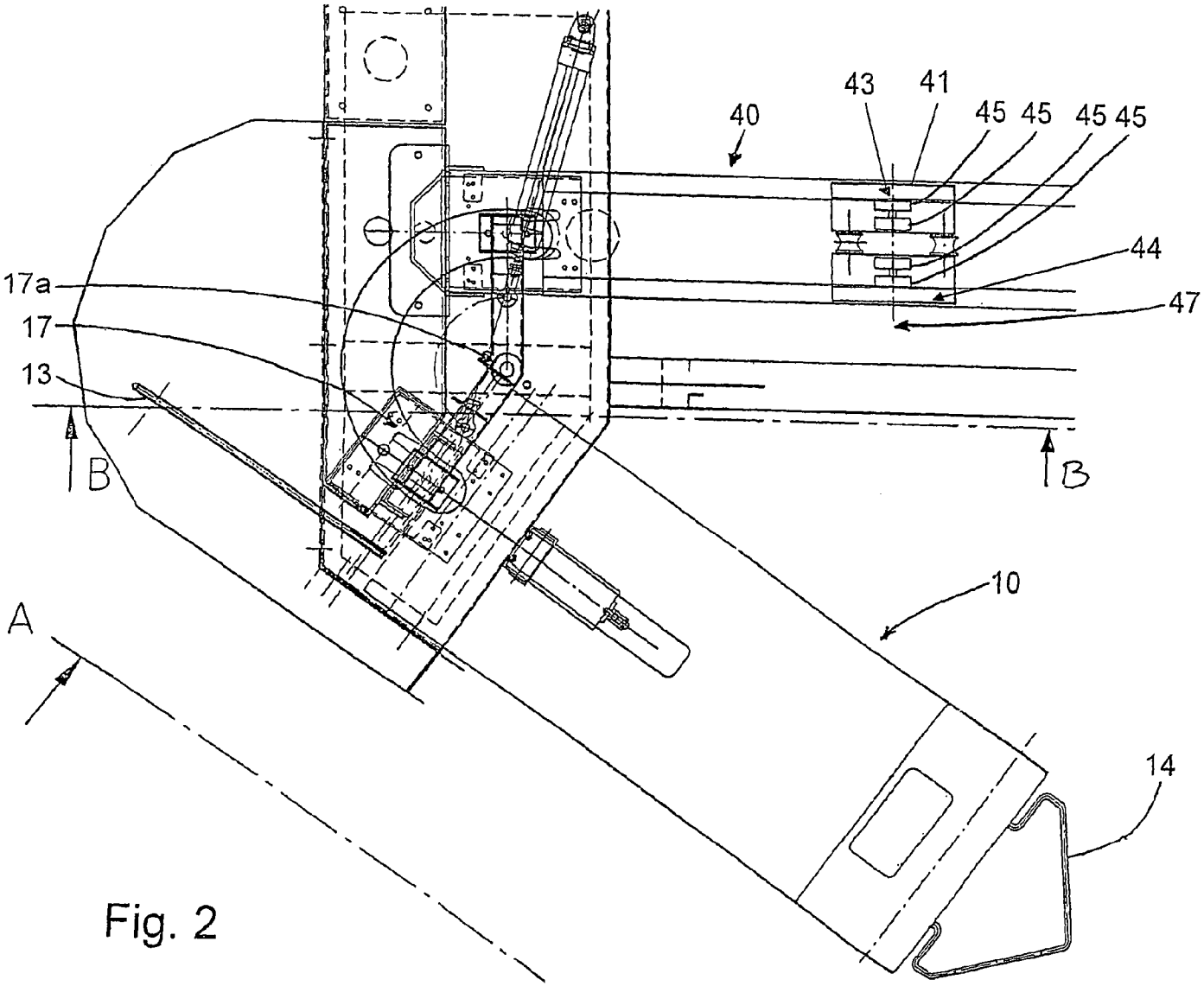
Figure 3:
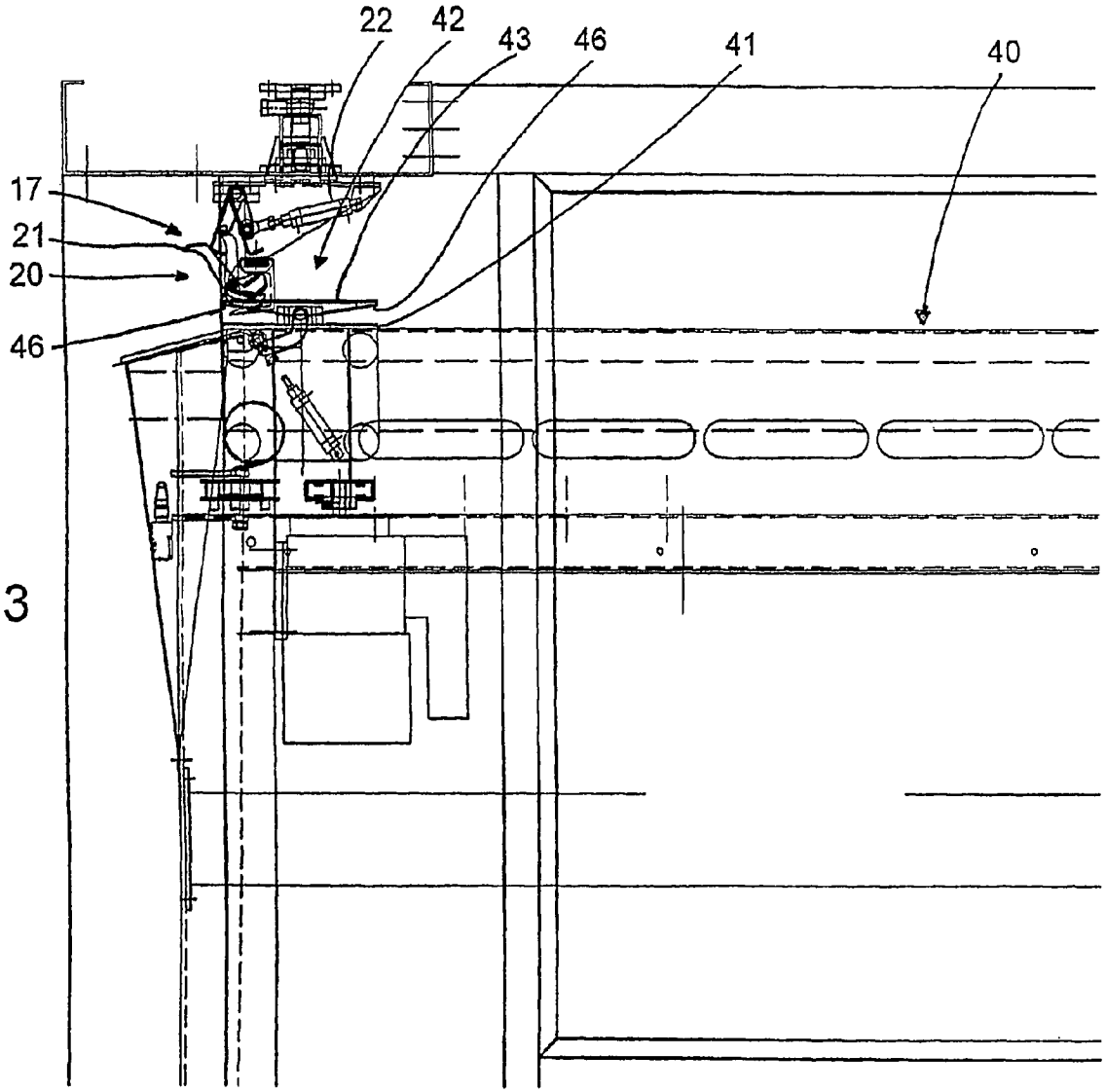
Figure 4:
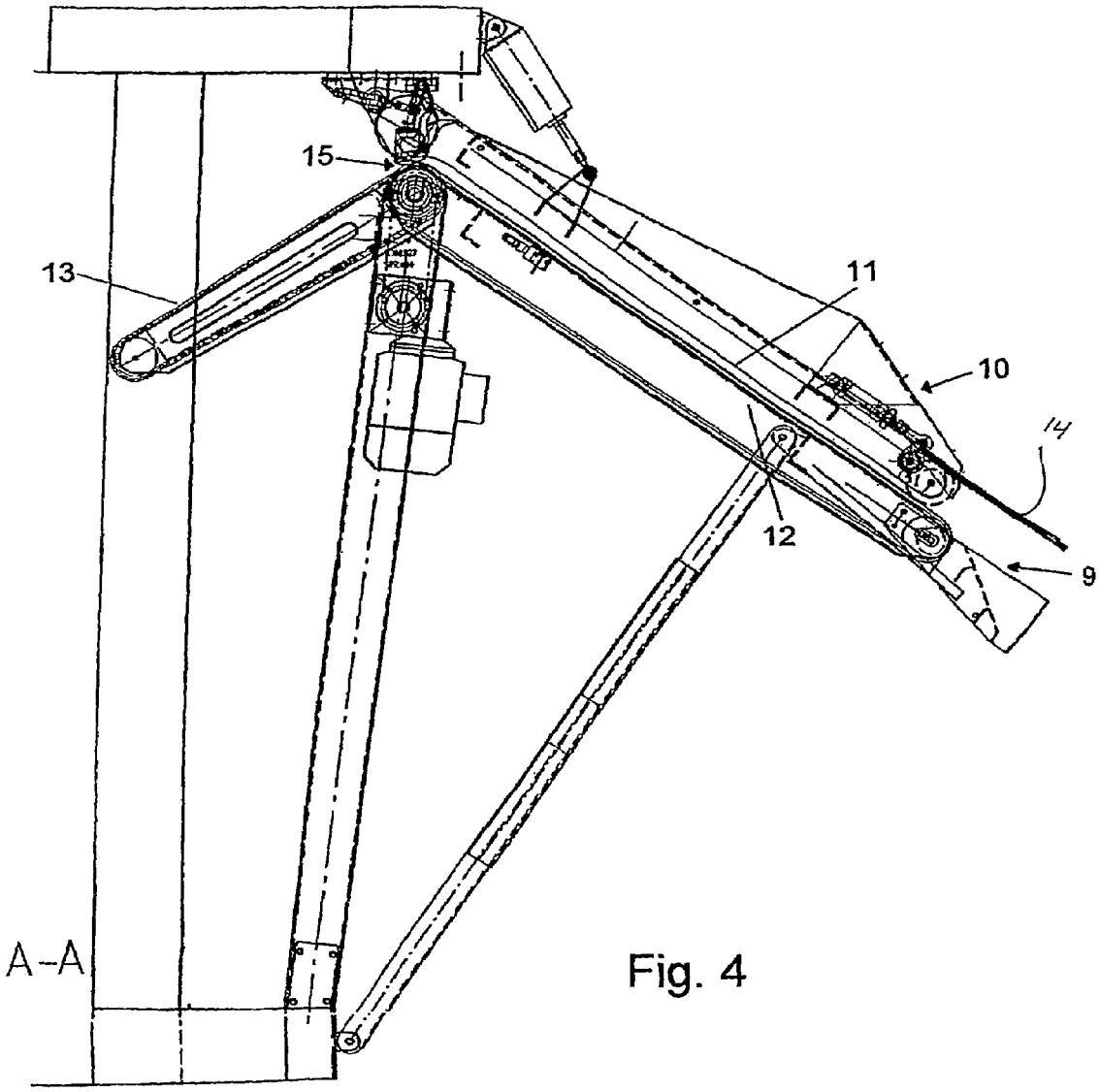

One embodiment of the invention will be described in detail in the following with reference to the drawing, in which FIG. 1 is an explanatory sketch of a preferred embodiment of a feeder in accordance with the invention, seen from above; and FIG. 2 is an enlarged sectional view of the embodiment shown in FIG. 1; and FIG. 3 is a section of a sectional view of the boom conveyor according to FIG. 1, seen along the line B-B; and FIG. 4 is a sectional view of the feed conveyor according to FIG. 1, seen along the sectional line A-A.

FIG. 1 shows, in a preferred embodiment of the invention, a part of a feeder, seen from above; wherein, at both sides of a transversely extending boom 40, a feed conveyor 10, a turning device 17, 18, guide means 13, and a boom conveyor 41 are movably arranged on the transversely extending boom 40, on which said boom conveyor 41 can be moved in the longitudinal expanse of the boom 40.

The feed conveyor 10 is configured at the end of the transverse boom and comprises a position 9 of feeding with a seizing position at the end opposite the position 13 of feeding. At the position 9 of feeding the feed conveyor comprises a brace 14. In the following, the feed conveyor 10 and the guide means 13 will be described in further detail.

In connection with the seizing position a turning device 17, 18 is arranged and configured as a pivot arm comprising a pair of mutually independently operating squeezers configured for securing a straightened front edge of a piece of cloth during transfer from the seizing position of the feed conveyor (10) to the boom conveyor. The piece of cloth is seized at the straightened front edge and taken with the boom conveyor across the boom, in such a manner that the piece of cloth hangs straightened across the boom. In subsequent process sub-steps, further means will further prepare the piece of cloth for the subsequent treatment.

In the preferred embodiment of the invention the feeding position 9 can be set to the shown position with a given angle in relation to the direction of conveyance of the feed conveyor 10 and the direction of conveyance of the feeder. However, it will be possible to locate the feed conveyor in any other position along the circular arch described by the possible positions to which an operator is able position the feed conveyor 10 by turning the feed conveyor 10. Thereby it will be possible to set the feed conveyor 10 in accordance with the relevant needs and desires within an angular range between 0° and 260°, determined by an angle between the direction of transportation of the feed conveyor 10 and the direction of transportation of the feeder. Likewise, the feed conveyor 10 may comprise means for adjusting the height of the feeding position 9 by which it will be possible for the operator to adjust the feed conveyor 10 vertically and hence the height of the feeding position 9 as needed.

FIGS. 2 and 3 are sectional views of the preferred embodiment of a feeder shown in FIG. 1.

FIG. 2 shows the transversally extending boom 40 with its boom conveyor 41 and the turning device 17 depicted in its two extreme positions.

From the figure it will appear that the turning position 17 is a pivot arm configured with a fixed point of rotation 17*a* about which it is pivotally journalled and pivotal between two extreme positions, in which the first extreme position is where the piece of cloth is received from the seizing position 15 by the feed conveyor 10, and wherein the second extreme position is where the piece of cloth is transferred to the boom conveyor 41 for conveyance across the boom 40.

The guide means 13 is shown configured in extension of the feed conveyor 10 in a first extreme position of the turning device (pivot arm) 17 with a distance to the fixed point to rotation 17*a*. The guide means has a length oriented in extension of and in the same direction as the direction of conveyance of the feed conveyor 10. On its top face the boom conveyor 41 is provided with a tilting-squeezer device 42 comprising two tilting squeezers 43, 44, in the figure illustrated by the positioning of the bearing units 45 about which they will tilt.

The tilting squeezers 43, 44 comprise squeezer means 46 at both ends with a view to the squeezer means 46 from the left tilting squeezers 43 being able to secure pieces of cloth transferred from the left turning device 17 by conveyance across the boom, and the squeezer means 44 from the right pair of tilting squeezers 44 are able to secure pieces of cloth transferred from the right turning device 18 by conveyance across the boom.

FIG. 3 is a sectional view along the line B-B shown in FIG. 2. From the Figure, the turning device 17 will appear, the boom 40 with the boom conveyor 41 in one extreme position, at which extreme position the not shown piece of cloth is transferred from the turning device 17 for conveyance across the boom 40 by the boom conveyor 41. On its top face, the boom conveyor 41 is provided with a tilting-squeezer device 42 consisting of two tilting squeezers 43, 44 with squeezer means 46 at both ends, and wherein the two tilting squeezers 43, 44 combine to form two pairs of tilting squeezers with a view to the one pair of tilting squeezers being able to secure pieces of cloth from the one turning device 17 and the second pair of tilting squeezers being able to secure pieces of cloth from the second turning device 18.

The tilting-squeezer device 42 comprises two tilting squeezers 43, 44 of which only the one tilting squeezer 43 will appear from the figure. These two tilting squeezers 43, 44 are mounted in parallel with and spaced apart in the transverse direction of the boom. At the ends of the tilting squeezers 43, 44 squeezer means 46 are provided such that, at the one side, the squeezer means 46 receive pieces of cloth from the one turning direction 17 and such that, at the other side, squeezer means 46 receive pieces of cloth from the other squeezer device 18.

Likewise, the turning device 17 is shown herein in an extreme position and rearwardly oriented squeezer devices 20 mounted on the turning device 17 having the squeezer means 21 shown in an open position and the associated actuator means 22. The rearwardly oriented squeezer means 20 on the turning device 17 are mounted at a mutual distance corresponding essentially to the width of the boom conveyor 41 such that a secured straightened front edge of the piece of cloth can be transferred to the tilting-squeezer device.

FIG. 4 is a sectional view along the lone A-A shown in FIG. 1. The feed conveyor 10 thus comprises a conveyor consisting to two superposed conveyor belts 11 configured next to each other. These superposed conveyor belts 11 abut on two sub-posed conveyor belts 12. In extension of the conveyor belt 11, 12 of the feed conveyor 10, the above-referenced guide means 13 is located. The guide means 13 comprises conveyor belt means with a direction of conveyance like that of the sub-posed conveyor belt 12, said guide means 13 serving to control the not shown piece of cloth, during the turning movement of the turning device from the seizing position 15 to the boom conveyor 41. The not shown piece of cloth is introduced between the superposed and the sub-posed conveyor belts 11, 12 at the feeding position 9, following which the conveyor belts 11, 12 are activated to move (pull) the not shown piece of cloth into the seizing position (the second position) 15 configured—seen in the direction of conveyance of the conveyor—at the opposite end of the feeding position 9. The shown guide means 13 is configured such that, during transfer from the seizing position 15 to the boom conveyor 41, the piece of cloth is conveyed across the guide means 13, whereby the down-hanging of the piece of cloth will be in contact with the guide means 13 during the movement, thereby avoiding that adverse folds are created on the piece of cloth during the movement that may prevent correct positioning of the piece of cloth on the boom.

The feed conveyor 10 and the turning device 17 are both characterised in that they are separate units thereby enabling each of them to temporarily store a piece of cloth, such that the operator does not have to way until a piece of cloth has been conveyed through the feeder until the next can be fed to the feed conveyor 10. This is ensured by means of guide means and thus it is obtained that the feeder according to the invention may have a buffer stock of pieces of cloth for being fed to the feeder (the conveyor). Said control and actuator means are not particular to the present invention; rather they can be defined and configured by the person skilled in the art in a variety of ways.

The invention claimed is:

1. A device for feeding an essentially rectangular piece of cloth prior to ironing to a feeder comprising:

a boom extending transversely of the direction of conveyance to the feeder, and wherein the boom comprises a boom conveyor for conveying the piece of cloth across the boom in the longitudinal direction thereof, said device having, at one end of the boom, a first feed conveyor having a feeding end situated in front of the boom seen in the direction of conveyance to the feeder, the feed conveyor designed to receive, at the feeding end, a straightened front edge of the piece of cloth and transfer the piece of cloth therefrom to the boom conveyor, and a first turning device provided between the boom conveyor and the end of the feed conveyor opposite the feeding end for turning and transferring the straightened front edge of the piece of cloth from the feed conveyor to the boom conveyor, wherein the boom has an opposite end, and a second feed conveyor is located at the opposite end of the boom for receiving a straightened front edge of a second piece of cloth and transferring the second piece of cloth to the boom conveyor, and a second turning device provided between the boom conveyor and the second feed conveyor.

2. A device according to claim 1, wherein the second feed conveyor has a second feeding end, and each feeding end is located between the ends of the boom when it is receiving a piece of cloth.

3. A device according to claim 1 or 2, wherein the angle between the direction of the first feed conveyor and the direction of conveyance to the feeder is in a range between 190° and 260°, and that the turning device is configured for receiving the front edge of the piece of cloth from the first feed conveyor and then turn the front edge of the piece of cloth through an angle in the aforesaid range, the front edge being subsequently received by the boom conveyor.

4. A device according to claim 1, wherein each feed conveyor, each turning device, and the boom conveyor are independent units each having a securing means and guide.

5. A device according to claim 1, wherein each feed conveyor comprises two parallel conveyor belts that run synchronously.

6. A device according to claim 1, wherein each turning device comprises a pair of mutually independently operating squeezers.

7. A device according to claim 1, wherein the boom conveyor comprises a tilting squeezer device having one pair of squeezers being able to securely squeeze pieces of cloth from the first turning device and another pair of squeezers being able to securely squeeze pieces of cloth from the second turning device.

8. A device according to any one of claims 1 and 5-7, further comprising a separate guide for each feed conveyor and having an extension oriented in the same direction as the direction of conveyance of the respective feed conveyor; whereby the piece of cloth is, by the transfer of the piece of cloth by the respective turning device from the feed conveyor to the boom, conveyed across the respective guide, and thereby avoiding that adverse folds are imparted to the piece of cloth prior to transferring the piece of cloth to the boom conveyor.

9. A device according to claim 3, wherein the range is preferably between 210° and 240°.

10. A method of introducing essentially rectangular pieces of cloth to a feeder prior to ironing, comprising the steps of:

conveying by a first feed conveyor a straightened front edge of an essentially rectangular piece of cloth, seizing by a turning device the straightened front edge of the piece of cloth from the first feed conveyor, turning with an essentially horizontal movement the straightened front edge of the piece of cloth, transferring to a boom conveyor from the turning device the straightened front edge of the piece of cloth, and conveying the essentially rectangular piece of cloth across a boom, wherein the boom has two ends, and the transferring step includes:

conveying the essentially rectangular piece of cloth across a boom, wherein the boom has two ends, and the transferring step includes:

transferring, at one of the two ends of the boom, the straightened front edge of the piece of cloth to the boom conveyor from the turning device, and wherein the first feed conveyor has a feeding end in which the straightened front edge of the piece of cloth is received, and comprising the additional step of:

placing, prior to receiving the piece of cloth, the feeding end at a position in front of the boom where the feeding end is situated between the two ends of the boom.

11. A method as claimed in claim 10, comprising the additional steps of:

conveying by a second feed conveyor a straightened front edge of a second essentially rectangular piece of cloth, seizing by a second turning device the straightened front edge of the second piece of cloth from the second feed conveyor, turning with an essentially horizontal movement the straightened front edge of the second piece of cloth, transferring to the boom conveyor at the other end of the boom the straightened front edge of the second piece of cloth, and conveying the second essentially rectangular piece of cloth across the boom.

* * * * *